US006877841B2

(12) United States Patent
Tanaka

(10) Patent No.: US 6,877,841 B2
(45) Date of Patent: Apr. 12, 2005

(54) ELECTROSTATIC INK JET HEAD AND A RECORDING APPARATUS

(75) Inventor: Shinji Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 7 days.

(21) Appl. No.: 10/469,194

(22) PCT Filed: Sep. 19, 2002

(86) PCT No.: PCT/JP02/09645

§ 371 (c)(1),
(2), (4) Date: Aug. 25, 2003

(87) PCT Pub. No.: WO03/026896

PCT Pub. Date: Apr. 3, 2003

(65) Prior Publication Data

US 2004/0070647 A1 Apr. 15, 2004

(30) Foreign Application Priority Data

Sep. 20, 2001 (JP) ..... 2001-286044

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,668,579 A 9/1997 Fujii et al.
5,912,684 A 6/1999 Fujii et al.

FOREIGN PATENT DOCUMENTS

| | | |
|---|---|---|
| EP | 0629502 | 9/1998 |
| EP | 0671271 | 7/2000 |
| JP | 7132598 | 5/1995 |
| JP | 7299908 | 11/1995 |

*Primary Examiner*—Raquel Yvette Gordon
(74) *Attorney, Agent, or Firm*—Cooper & Dunham LLP

(57) ABSTRACT

Frequency dependency of an electrostatic actuator is improved by setting a driving voltage waveform. It has an electrode (11) that counters a vibrating plate (21) that constitutes a part of the surface of a wall of an ink chamber, and the vibrating plate (21) and the electrode are provided with a predetermined gap (40). Pulse voltage is applied between the electrode (11) and the vibrating plate (21), displacement of which is carried out by electrostatic force that pressurizes ink in the ink chamber according to mechanical resilience of the vibrating plate (21) such that an ink drop is ejected. The vibrating plate (21) is vibrated such that it may contact the electrode (11), ejecting the ink by one or a plurality of electric pulses. A ratio of the period during which the vibrating plate contacts the electrode to the period required to form a pixel is regulated to be equal to or less than (200−2.79×PV) %, where PV is a per cent ratio of displacement volume of the vibrating plate to a vibrating chamber that is the space defined by the vibrating plate and a board of the electrode.

6 Claims, 18 Drawing Sheets

ELECTROSTATIC INK JET HEAD AND A RECORDING APPARATUS

TECHNICAL FIELD

The present invention relates to an electrostatic ink jet head, and a recording apparatus that uses the electrostatic ink jet head.

BACKGROUND ART

FIG. 1 is a perspective diagram for explaining the principal part of an ink jet head that uses electrostatic force, to which the present invention is to be applied, and FIG. 2 is a cross-sectional view of the principal part, showing the structure of an actuator of the ink jet head that is shown in FIG. 1 (outline cross-sectional view in a direction of the longer edge of a vibrating plate: a sectional view of FIG. 1 viewed at the line II—II). These figures show an electrode board 10 that includes an electrode 11, a liquid chamber board 20 that includes a vibrating plate 21 formed when an ink chamber 22 is carved, and a common ink chamber 23 that supplies ink to each ink chamber, and a nozzle board 30 that includes a nozzle 31 that discharges the ink in the liquid chamber 22. The electrode board 10, the vibrating board (liquid chamber board) 20, and the nozzle board 30 are laminated. (Although FIG. 1 and FIG. 2 show an example of a side shooter structure, an end shooter structure may be used.) In the vibrating board 20, which serves as a part of the ink chamber 22 and as a part of the common liquid chamber 23, the ink chamber 22 that is connected with the nozzle 31, and the vibrating plate 21 that is conductive and made thin in order to attain low rigidity such that it is flexible are provided.

The electrode board 10 includes an individual electrode 11 that is installed facing the vibrating plate 21 with a predetermined gap from the vibrating plate outside the ink chamber. Although a protection film 12 for preventing a short circuit etc. with the vibrating plate 21 is formed on the individual electrode 11, a protection film may also be formed in the back (on the side that faces the electrode) of the vibrating plate 21, if desired.

As shown in FIG. 1, a plurality of actuators as shown in FIG. 2 are installed in the electrostatic ink jet head to which the present invention is to be applied, and an ink drop is discharged from each of the actuators.

In FIG. 1 and FIG. 2, when voltage is applied between the vibrating plate 21 and the individual electrode 11, the vibrating plate 21 is displaced toward the electrode 11 by electrostatic force. When the voltage is removed, the vibrating plate 21 returns to the previous position, that is, the position before the voltage was applied. The electrostatic ink jet head uses this mechanical behavior in response to the electrostatic force of the vibrating plate 21 as the ink discharging force of an ink jet. In each actuator, a space 40 that is formed by the electrode board 10 and the vibrating board 20 is called a gap chamber, and a space that is a part of the gap chamber, formed by the vibrating plate and the electrode board is called a vibrating chamber.

In the electrostatic ink jet head as mentioned above, the vibrating plate 21 is made thin in order that a driving voltage to generate the electrostatic force between the vibrating plate 21 and the individual electrode 11, which displaces the vibrating plate 21, can be low, the voltage being applied between the vibrating plate 21 and the individual electrode 11 of the electrostatic actuator. A thin vibrating plate requires a lower driving voltage, however, rigidity of the vibrating plate becomes low. Where the rigidity is low, presence of air (or other gas) in the vibrating chamber and the gap chamber greatly affects the behavior of the vibrating plate. For example, when the vibrating plate 21 approaches the electrode 11, compression resistance of the air causes the voltage required to make the vibrating plate 21 contact the electrode 11 (the voltage is hereafter called the contact voltage) to become large in a dynamic situation, as compared with a static situation. To this problem, certain measures have been developed. For example, a Japan Provisional Publication No. 7-299908 has been published, wherein a gap chamber is provided in addition to the vibrating chamber such that the air escapes when the vibrating plate is displaced toward the electrode side, and the compression resistance of the air is prevented.

The present invention is made for the purpose of coping with another significant problem, as explained below, resulting from the presence of the air as mentioned above.

Sections (A) through (D) of FIG. 3 show an outline structure of the principal part of the electrostatic ink jet head, and are for explaining the problem to be solved by the present invention. The sections (A) and (B) of FIG. 3 show a range of actual displacement (L) of the vibrating plate when the driving frequency is low. The sections (C) and (D) of FIG. 3 show the range of actual displacement (1) of the vibrating plate when the driving frequency is high.

The sections (A) and (C) of FIG. 3 show sectional views in the longer edge direction of the vibrating plate. The sections (B) and (D) of FIG. 3 show sectional views in the shorter edge direction of the vibrating plate. The vibrating plate of the conventional electrostatic ink jet head is required to vibrate dynamically in a range of up to 10 kHz. Since the space between the vibrating plate and the electrode is narrow, wherein the vibrating plate vibrates at a high speed, as mentioned above, the vibrating plate 21 receives compression resistance of air during the period of movement toward the electrode 11. A portion of the air escapes to outside of the vibrating chamber 40 (as an arrow shows), according to the vibration. This phenomenon is called a squeezing effect. Then, when the voltage is removed and the vibrating plate 21 separates from the electrode 11, the inside of the vibrating chamber 40 is reduced to a state of negative pressure compared to the atmosphere. Due to this, the position to which the vibrating plate 21 returns is a position closer to the electrode 11 than the original position. Here, the amount of the air that is pushed out from the vibrating chamber 40 in a certain unit period increases as the proportion of the period during which the vibrating plate 21 contacts the electrode 11 increases. That is, the higher the driving frequency is, and the wider the driving electric pulse width is, the larger the amount of the air pushed out from the vibrating chamber to the outside is, and the larger the negative pressure of the vibrating chamber is, making the position to which the vibrating plate returns when the electric pulse is turned off to be closer to the electrode.

FIG. 9 shows an example (contacting period dependency of a parallel gap). The figure shows a result of measurement of vibrating displacement at the center position in the shorter edge direction of the vibrating plate of the actuator, the measurement being performed by a laser Doppler vibrograph. The vertical axis represents a displacement amount $\delta$, and the horizontal axis represents magnitude of the driving voltage, where the waveform of the driving voltage is rectangular. The $\delta$-V characteristic is expressed with the driving frequency serving as a parameter. There are areas where a displacement amount saturates at a certain voltage. The saturated displacement amount is called the contact displacement amount.

In reference to FIG. 9, the higher the driving frequency is, the larger the amount of the air that is pushed out from and cannot return to the vibrating chamber is. For this reason, as the sections (C) and (D) of FIG. 3 indicate, the vibrating plate 21 vibrates closer to the electrode 11, making the distance between the electrode and the vibrating plate substantially short, causing the contact voltage to drop. Thus, there is a phenomenon that does not cause a problem when the driving frequency is low, but becomes a problem when the frequency is made higher, and when the pulse width of the driving voltage is made wider.

Although the above subject is not a problem in a conventional electrostatic ink jet head that operates at most at about 10 kHz, it is a problem that should be solved in a head that serves a future high-speed printer. However, no countermeasure to this problem has been proposed.

Here, the problem is applicable to contact driving in which the vibrating plate contacts the electrode. In the case of non-contact driving in which it does not contact, the frequency dependent problem mentioned above does not arise or does not pose a problem.

DISCLOSURE OF THE INVENTION

The present invention is made in view of the present situation as mentioned above with an objective to improve the frequency dependency of the electrostatic actuator only by setting up the waveform of the driving voltage.

The present invention provides an electrostatic ink jet head, which includes a vibrating plate, and an electrode installed facing the vibrating plate at a predetermined gap, wherein, an electric pulse is applied between the electrode and the vibrating plate such that the vibrating plate is displaced by electrostatic force, and an ink drop is discharged by mechanical resilience of the vibrating plate pressurizing ink in the ink chamber, wherein, a pixel is formed by ink that is discharged by one electric pulse, where a ratio PT of a period during which the vibrating plate and the electrode contact each other to a period required to form a pixel is equal to or less than (200−2.79×PV) %, where PV is a per cent ratio of the displacement volume of the vibrating plate to the volume of a vibrating chamber that is the space enclosed by the vibrating plate and a board of the electrode.

The present invention also provides an electrostatic ink jet head, and an electrode installed facing the vibrating plate at a predetermined gap, wherein, an electric pulse is applied between the electrode and the vibrating plate such that the vibrating plate is displaced by electrostatic force, and an ink drop is discharged by mechanical resilience of the vibrating plate pressurizing ink in the ink chamber; wherein, a pixel is formed by ink that is discharged by a plurality of electric pulses, where a ratio PT of a period during which the vibrating plate and the electrode contact each other to a period required to form a pixel is equal to or less than (200−2.79×PV) %, where PV is a per cent ratio of displacement volume of the vibrating plate to the volume of a vibrating chamber that is the space enclosed by the vibrating plate and a board of the electrode.

The present invention also provides an electrostatic ink jet head, which includes a nozzle, an ink chamber that is connected to the nozzle, a vibrating plate that constitutes a common electrode, an individual electrode installed outside the ink chamber, and facing the vibrating plate at a predetermined gap, and a plurality of electrostatic actuators that discharge ink drops from the nozzle, the ink being in the ink chamber and pressurized by mechanical resilience of the vibrating plate when the vibrating plate is deformed by electrostatic force generated by an electric pulse applied between the vibrating plate and the individual electrode, where a ratio PT of a period during which the vibrating plate and the electrode contact each other to a period required to form a pixel is equal to or less than (200−2.79×PV) %, where PV is a per cent ratio of displacement volume of the vibrating plate to the volume of a vibrating chamber that is the space enclosed by the vibrating plate and a board of the electrode.

The present invention also provides the electrostatic ink jet head as described above, wherein one electric pulse is applied between the vibrating plate and the individual electrode when forming one pixel.

The present invention also provides the electrostatic ink jet head as described above, wherein a plurality of electric pulses are applied between the vibrating plate and the individual electrode when forming one pixel.

The present invention provides an ink jet recording apparatus, which includes the electrostatic ink jet head as described above, wherein the electrostatic ink jet head faces recording paper such that recording is performed by jetting ink drops.

BRIEF DESCRIPTION OF THE DRAWINGS

FIG. 5 shows an outline of a gap type of the electrostatic ink jet head experimented with.

Figure 13:
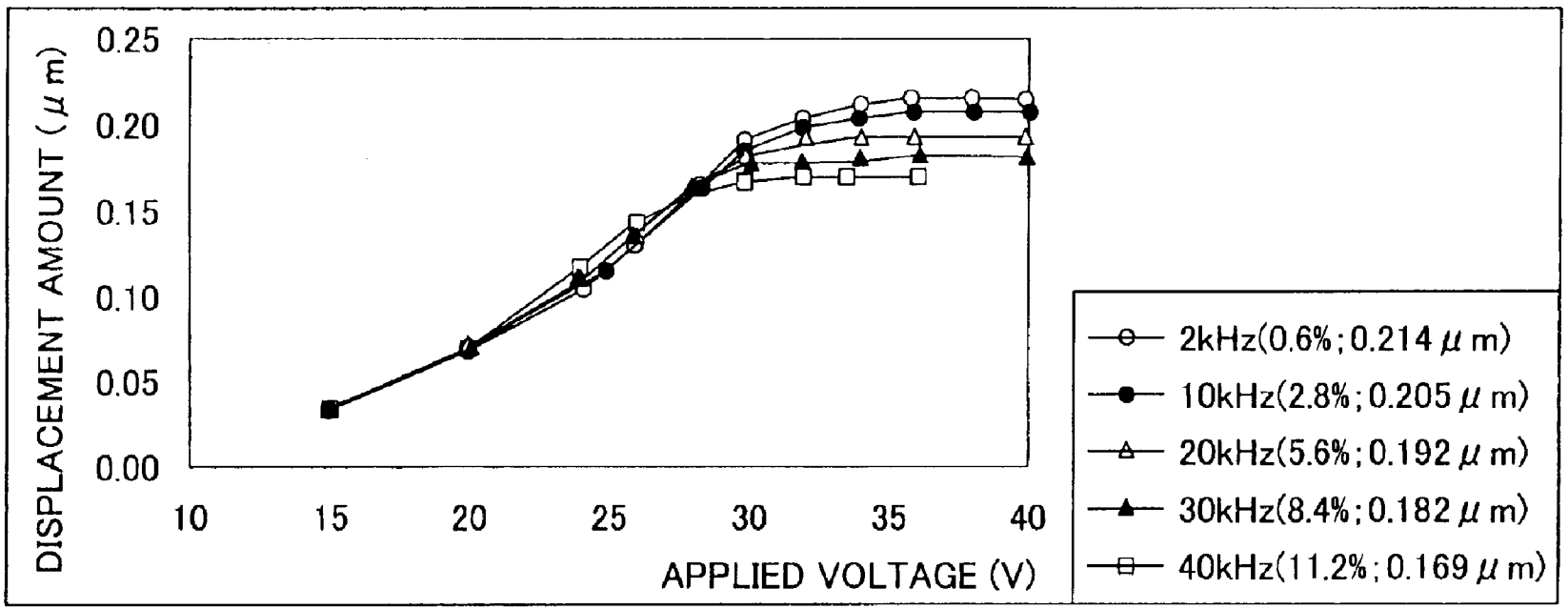

FIG. 13 shows contacting period dependency of a non-parallel gap G1 form, the contacting period being 2.8 microseconds.

Figure 14:
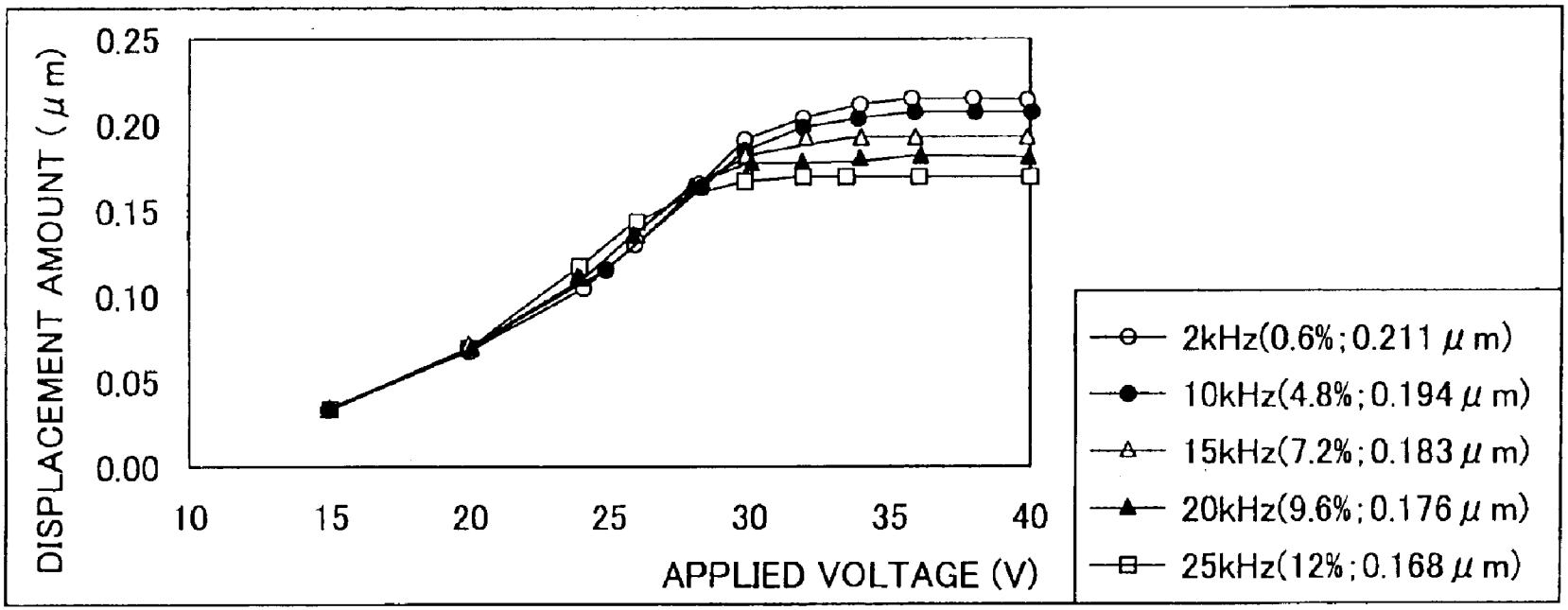

FIG. 14 shows the contacting period dependency of the non-parallel gap G1 form, the contacting period being 4.8 microseconds.

Figure 15:
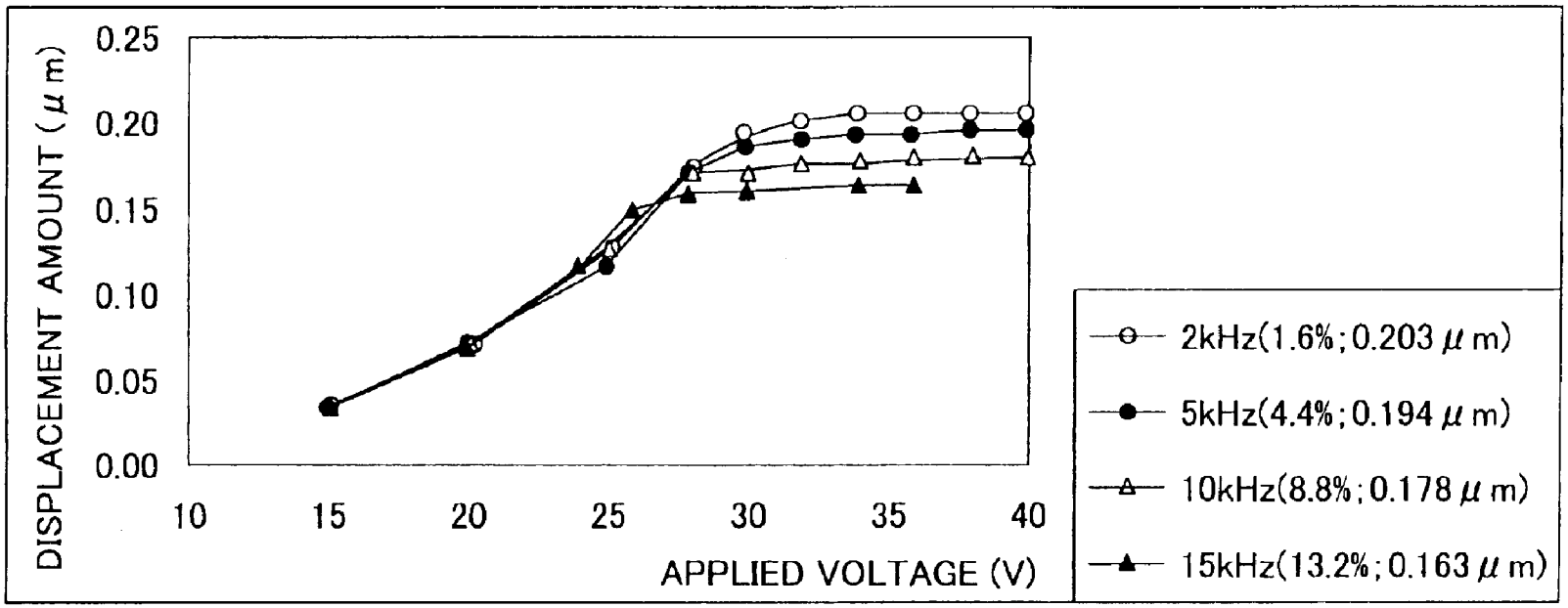

FIG. 15 shows the contacting period dependency of the non-parallel gap G1 form, the contacting period being 8.8 microseconds.

Figure 16:
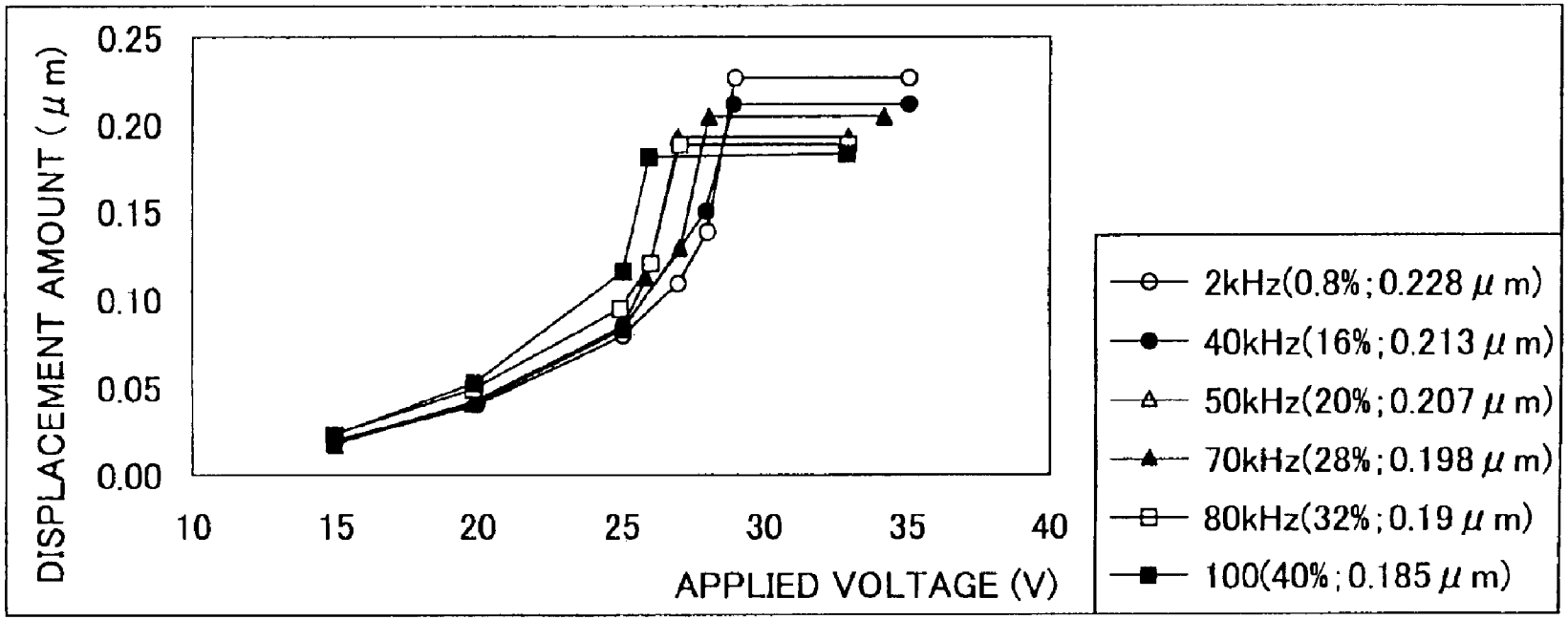

FIG. 16 shows the contacting period dependency of the non-parallel gap G2 form, the contacting period being 4.0 microseconds.

Figure 17:
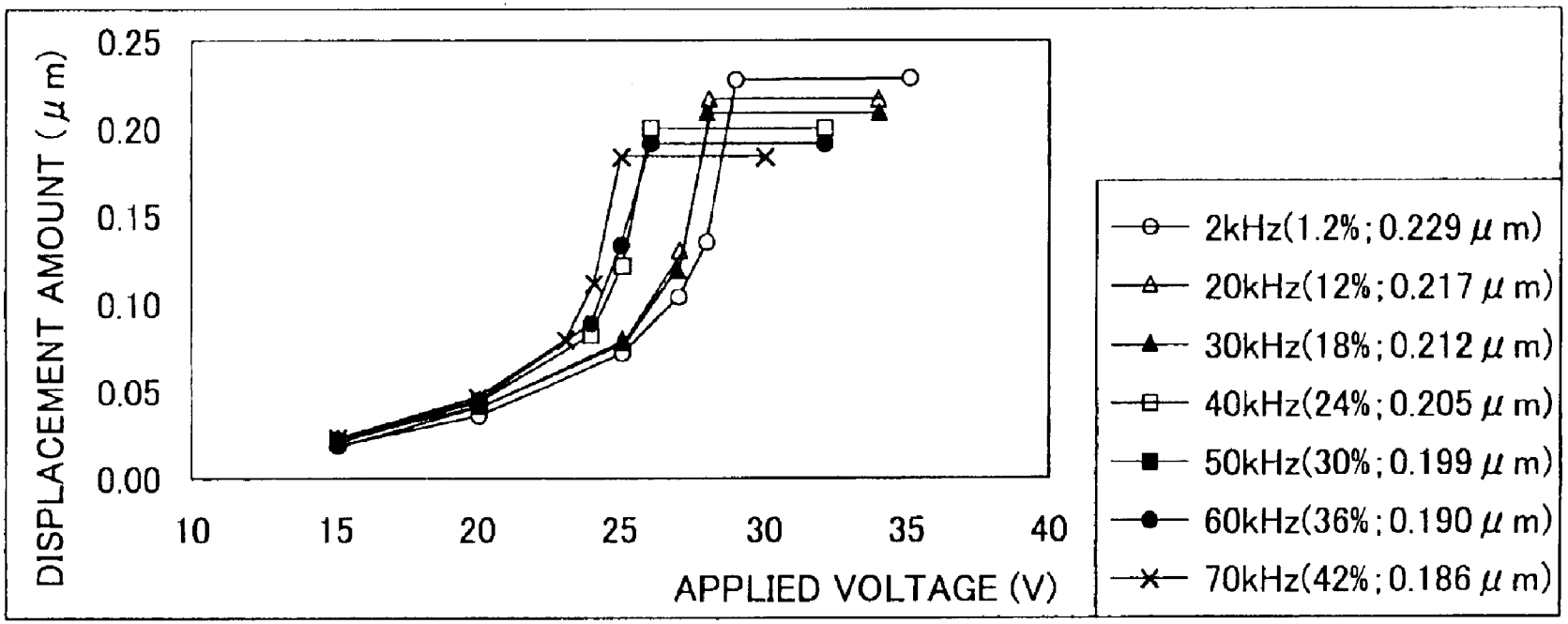

FIG. 17 shows the contacting period dependency of the non-parallel gap G2 form, the contacting period being 6.0 microseconds.

Figure 18:
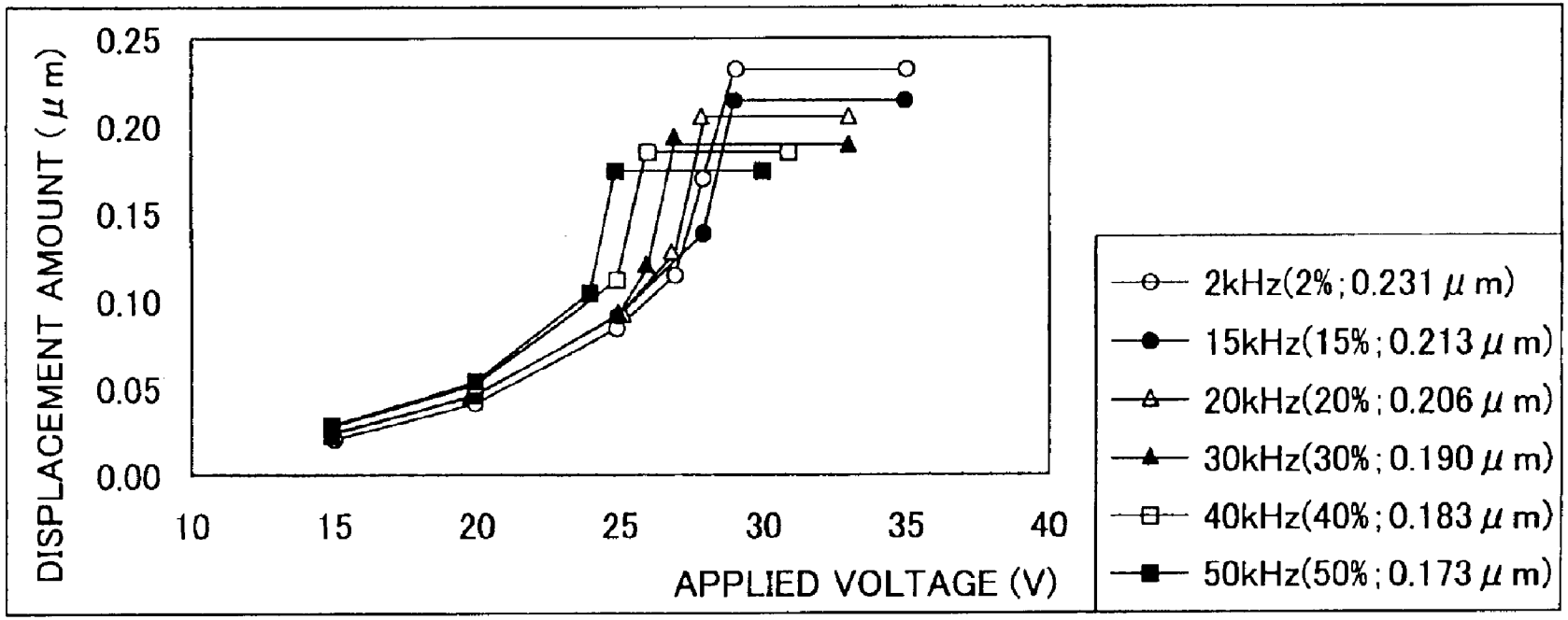

FIG. 18 shows the contacting period dependency of the non-parallel gap G2 form, the contacting period being 10.0 microseconds.

Figure 19:
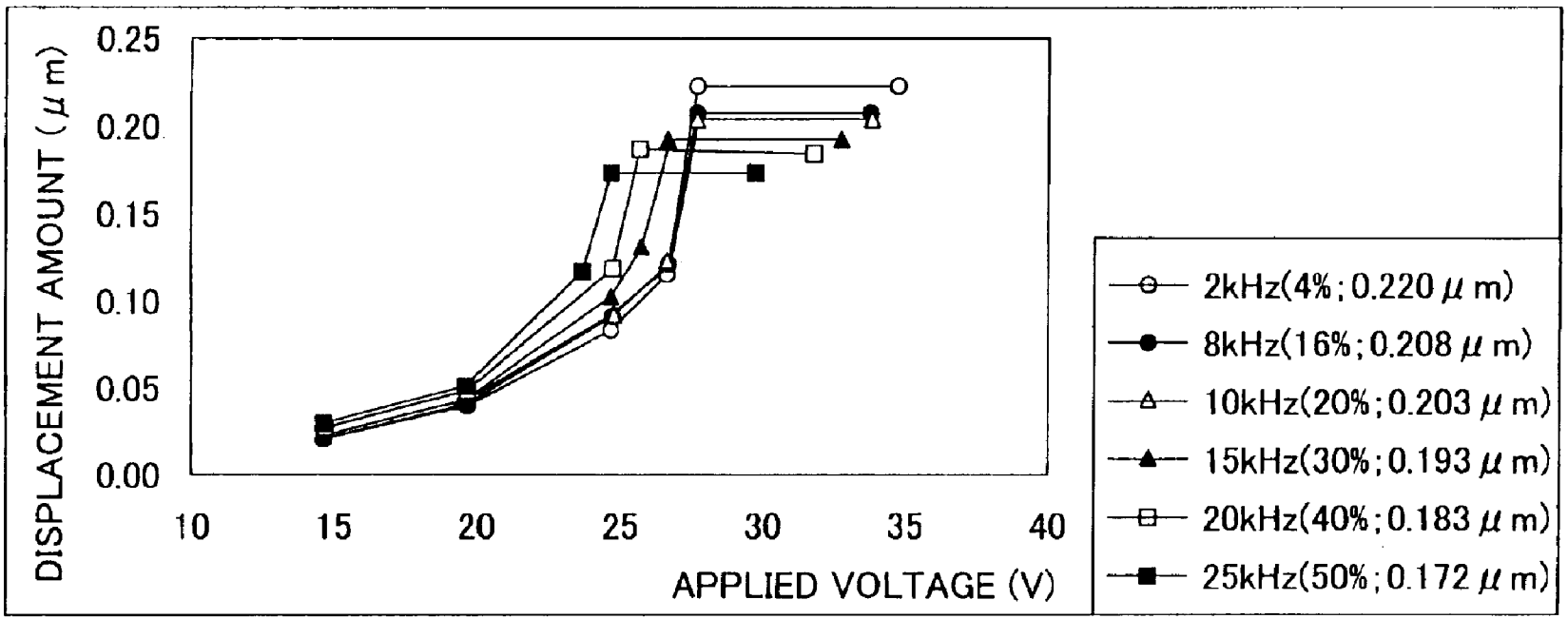

FIG. 19 shows the contacting period dependency of the non-parallel gap G2 form, the contacting period being 20.0 microseconds.

BEST MODE FOR CARRYING OUT THE INVENTION

Figure 1:
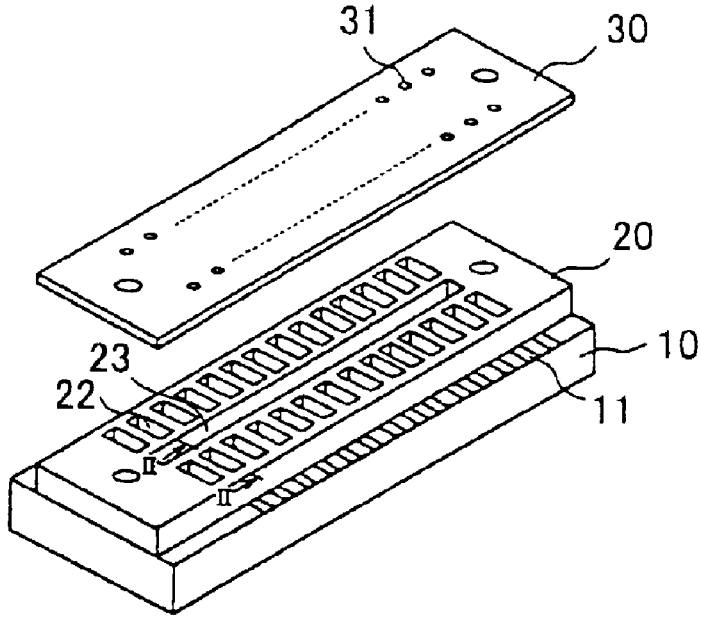
FIG. 1 is a perspective diagram for explaining a principal part of an ink jet head using electrostatic force to which the present invention is to be applied.
Figure 2:
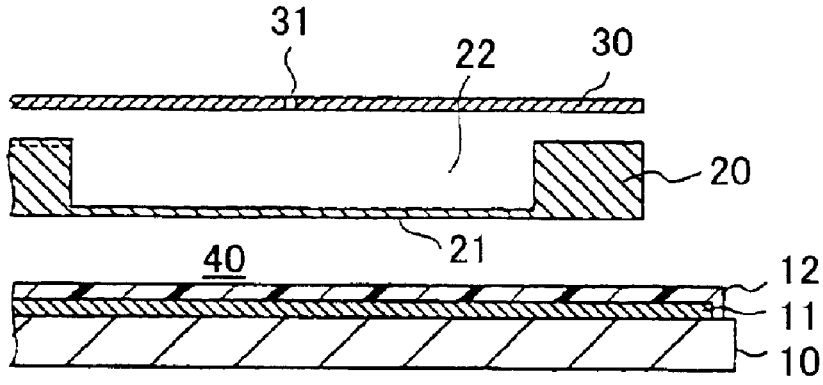
FIG. 2 shows a sectional view of a structure of a principal part of an actuator of the ink jet head shown in FIG. 1.
Figure 3:
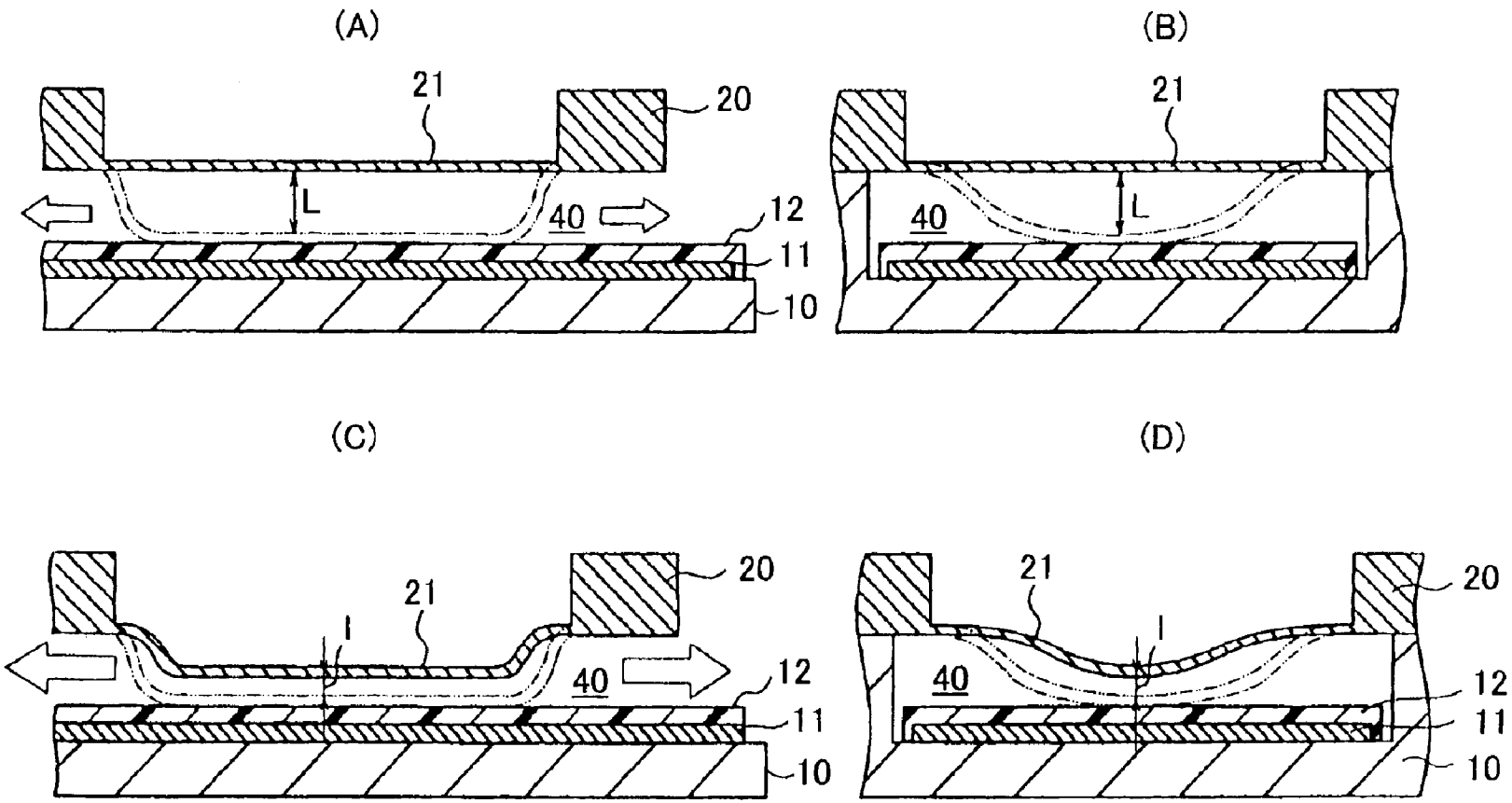
FIG. 3 shows an outline structure of a principal part of the electrostatic ink jet head for explaining the subject of the present invention.

The present invention provides an electrostatic ink jet head as shown in FIG. 1 and FIG. 2, which includes a nozzle 31, an ink chamber 22 that is connected to the nozzle 31, a vibrating plate 21 formed as a part of the ink chamber 22 and as a part of a common electrode, and an individual electrode 11 that is provided facing the vibrating plate 21 and being apart from the ink chamber 22 with a predetermined gap, and further includes a plurality of electrostatic actuators that are capable of discharging ink from the nozzle 31 when the vibrating 21 plate that is once deformed by electrostatic force generated by applying an electric pulse between the vibrating plate 21 and the individual electrode 11 restores when the voltage is removed by mechanical resilience, wherein frequency dependency is greatly suppressed by making the contacting period during which the vibrating plate and the electrode are in contact to be less than (200−2.79×PV) % of a period required to form a pixel, where PV is a percent ratio of displacement volume of the vibrating plate to volume of the vibrating chamber that is the space enclosed by the vibrating plate and the electrode board, when a pixel is formed by the electric pulse.

Figure 4:
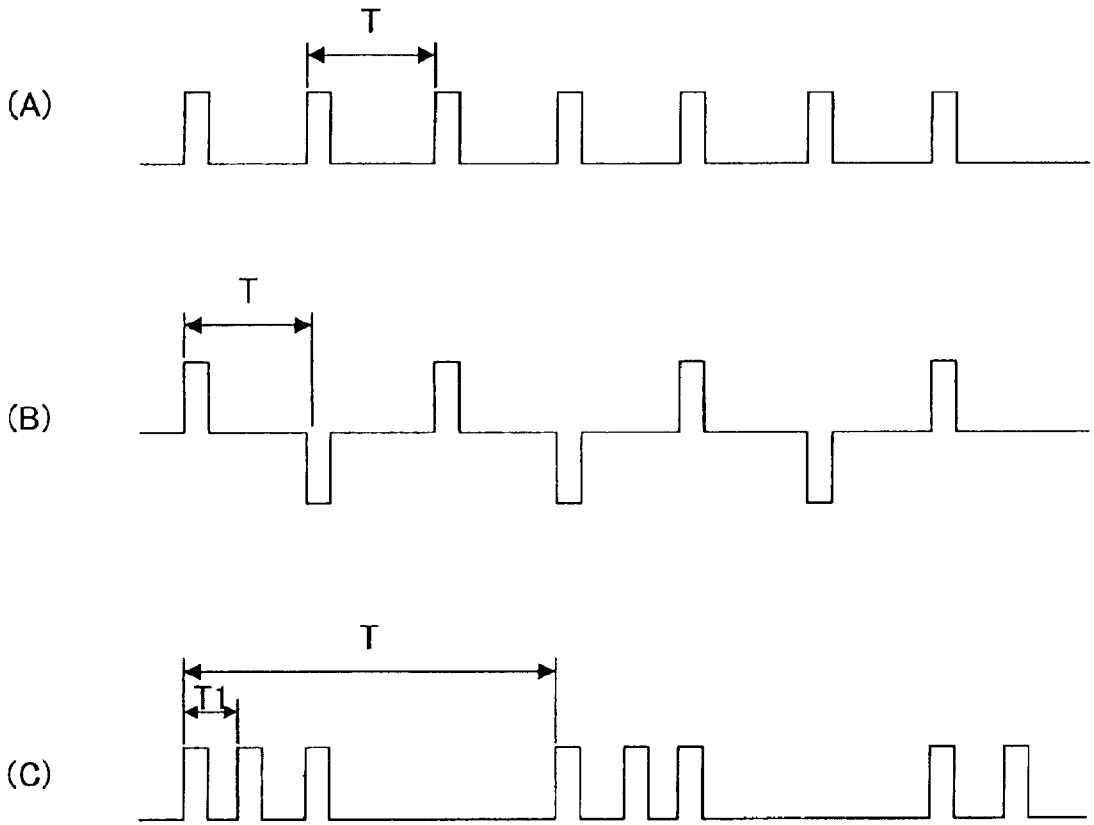
FIG. 4 shows an example of driving electric pulses applied between a vibrating plate and an individual electrode.

Sections (A), (B) and (C) in FIG. 4 show examples of driving electric pulses applied between the vibrating plate and the individual electrode. For a pixel, either one pulse or a plurality of pulses can be applied as the driving voltage. The section (A) of FIG. 4 shows an example wherein one driving pulse forms a pixel. The section (BY of FIG. 4 shows an example, wherein both positive and negative pulses (a negative pulse also displaces the vibrating plate) are used (applying the positive and negative electric pulses removes a residual electric charge particular to the electrostatic ink jet head). The section (C) of FIG. 4 shows an example wherein a plurality of pulses (that is, a plurality of ink drops) are used when forming a pixel. Here, when forming a pixel by the plurality of pulses, an ink dot does not need to be circular, and ink dots do not have to merge perfectly to form a dot on a recording medium, but rather, a structure may be such that the plurality of minute dots are to form approximately one dot. Further, although not illustrated, a structure may be such that a voltage that is not 0 is applied during a period while the ink is not being discharged.

Here, in the present invention, driving voltage is the voltage at which the vibrating plate contacts the electrode. In the case of one pulse per pixel, one contact is made to form a pixel. In the case of n pulses per pixel, n contacts are made to form a pixel. For example, in the examples shown in the sections (A) and (B) of FIG. 4, one pulse is applied per pixel, and the highest driving frequency is 1/T (where T is a period required in forming a pixel). On the other hand, in the example shown in the section (C) of FIG. 4, a plurality of pulses are applied to form a pixel, and the highest driving frequency is 1/T1.

As mentioned, the present invention controls the period during which the vibrating plate contacts the electrode to be equal to or shorter than (200−2.79×PV) % of T that is a period required to form one pixel, where PV is a per cent ratio of displacement volume of the vibrating plate to the volume of the vibrating chamber that is the space enclosed by the vibrating plate and the electrode board during T, that is, the period required to form one pixel. In the case of the section (C) of FIG. 4, even if the period during which the vibrating plate contacts the electrode is longer than (200−2.79×PV) % of T1 that corresponds to the highest driving frequency, the effect of the present invention, i.e., suppression of the frequency dependency, is available so long as it is shorter than (200−2.79×PV) % of T. Here, derivation of the value, (200−2.79×PV) %, will be explained in the description of an embodiment that follows.

To be accurate, the squeezing effect of the electrostatic head is dependent on the rate of the periods during which the vibrating plate contacts the electrode in the one-pixel-forming period, that is, the driving frequency is not the only element. That is, the above-mentioned frequency dependency represents one element of the dependency on the ratio of the contacting period to the one-pixel-forming period (it is hereinafter described as the dependency on the contacting period/pixel-forming period). Here, the dependency on the contacting period/pixel-forming period is the period for forming a pixel including the case where a plurality of ink drops are recognized as a pixel, even if the formed dot is not circular nor one dot.

The higher the driving frequency is set, the narrower becomes the range within which the pulse width of the driving voltage can be set. As a result, an optimum pulse width at which ink discharging is best performed may not be available for selection due to a specific vibration frequency, meniscus vibration, etc., of a head due to the structure of the head. However, overall ink discharging efficiency and frequency characteristics are clearly improved when adopting the structure of the present invention, even if ink discharging is not performed under the best conditions.

One of the important parameters that determine image quality is the dot diameter determined by a permitted range of displacement reduction. The dot diameter is dependent on many parameters, such as volume of ink, jet speed, quality of recording paper, and other environmental factors, and the dot diameter on a picture can differ with the same ink drop volume. As for a distribution of dot diameter differences, there is no generally accepted range that is permissible. In the present invention, the error tolerance level of the dot diameter is set as ±10%. Moreover, it is assumed that the ink volume linearly determines a spread area of the ink on the recording paper. Then, the ink volume is required to be within a range between 0.9025 (that is, 0.95×0.95)×M and 1.1025 (that is, 1.05×1.05)×M, which gives approximately a ±10% range, where M represents the desired ink volume, and R represents the radius of the dot, the tolerance for R being ±5%. Since, in the electrostatic head, an aspect ratio [width of the vibrating plate/gap] is 100 or greater, the displacement ratio of the displacement amount of the vibrating plate is almost equal to the ratio of the exhausting volume. Therefore, in order to suppress the variation of the dot diameter within the ±10% range, the displacement ratio of the vibrating plate should be suppressed within ±10% range.

Specification of an electrostatic actuator:

The basic structure of the head is as shown in FIG. 1 and FIG. 2. An electrode board 10 is etched such that a gap chamber is formed, with an individual electrode film 11 formed using TiN. A protection film 12 made of SiO is formed on the electrode. Moreover, a Si board 20 is etched such that a liquid chamber 22 is formed. A thin board that is formed in this manner serves as a vibrating plate 21. The above-mentioned two boards are joined to serve as an electrostatic head 40.

Figure 5:
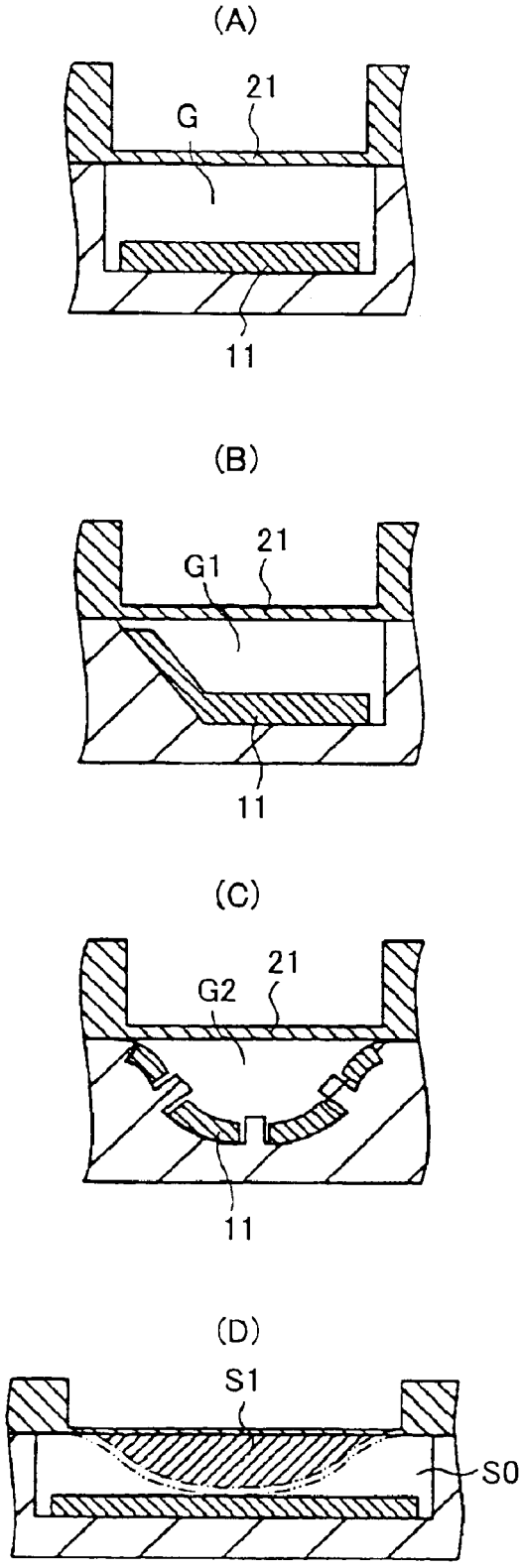

FIG. 5 shows an outline of the gap type of the electrostatic ink jet head made as an experiment. At (A), FIG. 5 shows a parallel gap G formed by the individual electrode 11 installed in parallel to the vibrating plate 21. At (B), FIG. 5 shows a non-parallel gap G1 formed by the vibrating plate 21 and the electrode 11, wherein one end in the shorter edge direction of the vibrating plate is almost touching the electrode. At (C), FIG. 5 shows a non-parallel gap G2 formed by the vibrating plate 21 and the electrode 11, wherein both ends in the shorter edge direction of the vibrating plate are almost touching the electrode.

Principal dimensions of the actuator are as follows. Here, only for the non-parallel gap G1, an oxidization film is formed on the back of the vibrating plate 21 as a protection film.

Parallel gap head ((A) of FIG. 5)

Gap between the vibrating plate and the electrode: Parallel gap G shown at (A) of FIG. 5

Gap length: 0.2 μm (specification: 0.2 μm)

Vibrating plate thickness (specification): 2.5 μm

Vibrating plate area: 130 μm×2000 μm.

Non-parallel gap head ((B) of FIG. 5)

Gap between the vibrating plate and the electrode: Non-parallel gap G1 shown at (B) of FIG. 5

The maximum gap length: 0.21 μm (specification: 0.2 μm)

Vibrating plate thickness (specification): 2.5 μm

Vibrating plate area: 130 μm×1000 μm.

Non-parallel gap head ((C) of FIG. 5)

The gap between the vibrating plate and the electrode: Non-parallel gap G2 shown in (C) of FIG. 5

The maximum gap length: 0.23 μm (specification: 0.25 μm)

Vibrating plate thickness (specification): 2.5 μm

Vibrating plate area: 125 μm×2000 μm.

Figure 6:
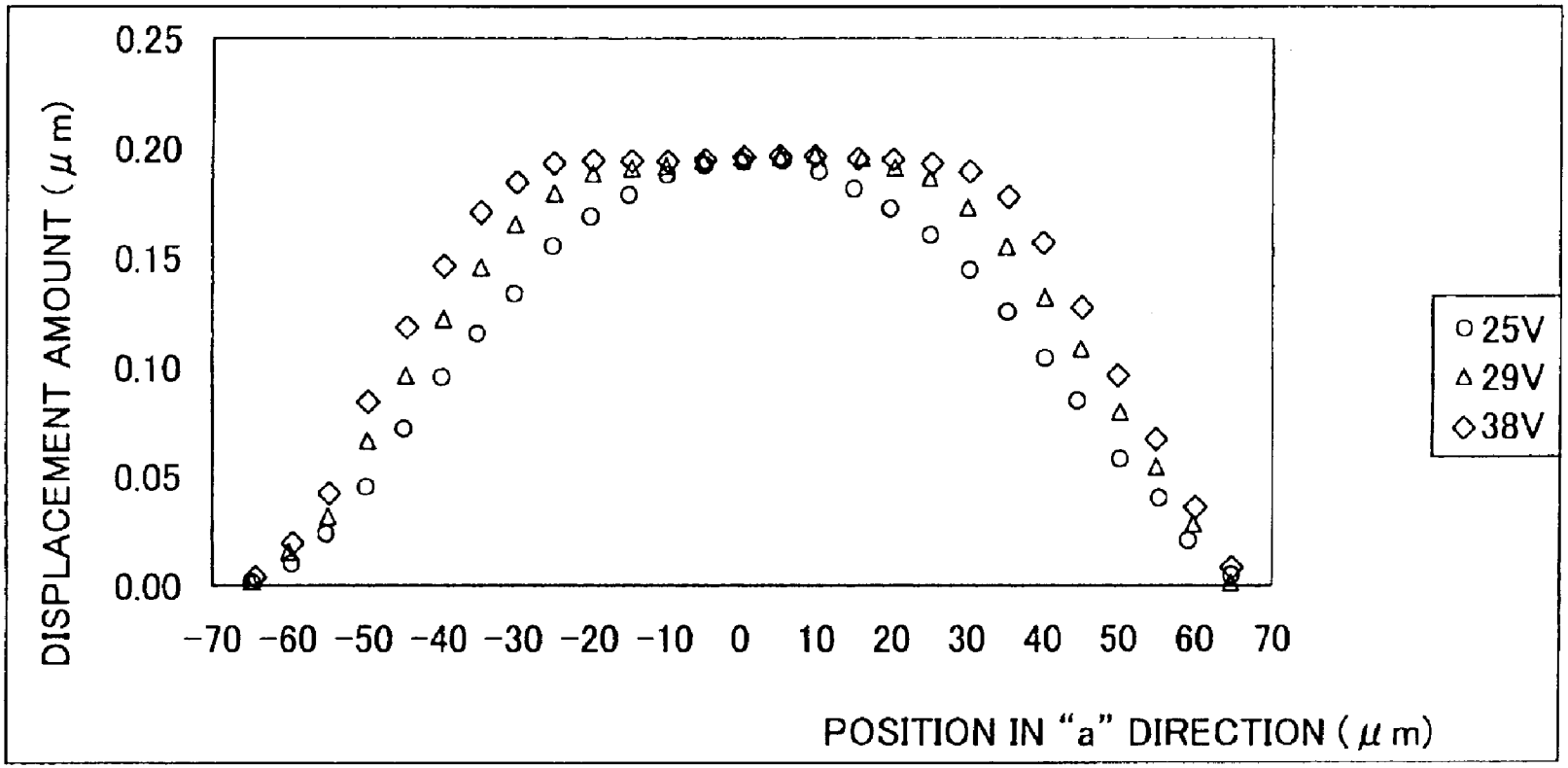
FIG. 6 shows a measurement result of displacement of a parallel gap type actuator in a longer edge direction of the vibrating plate.
Figure 7:
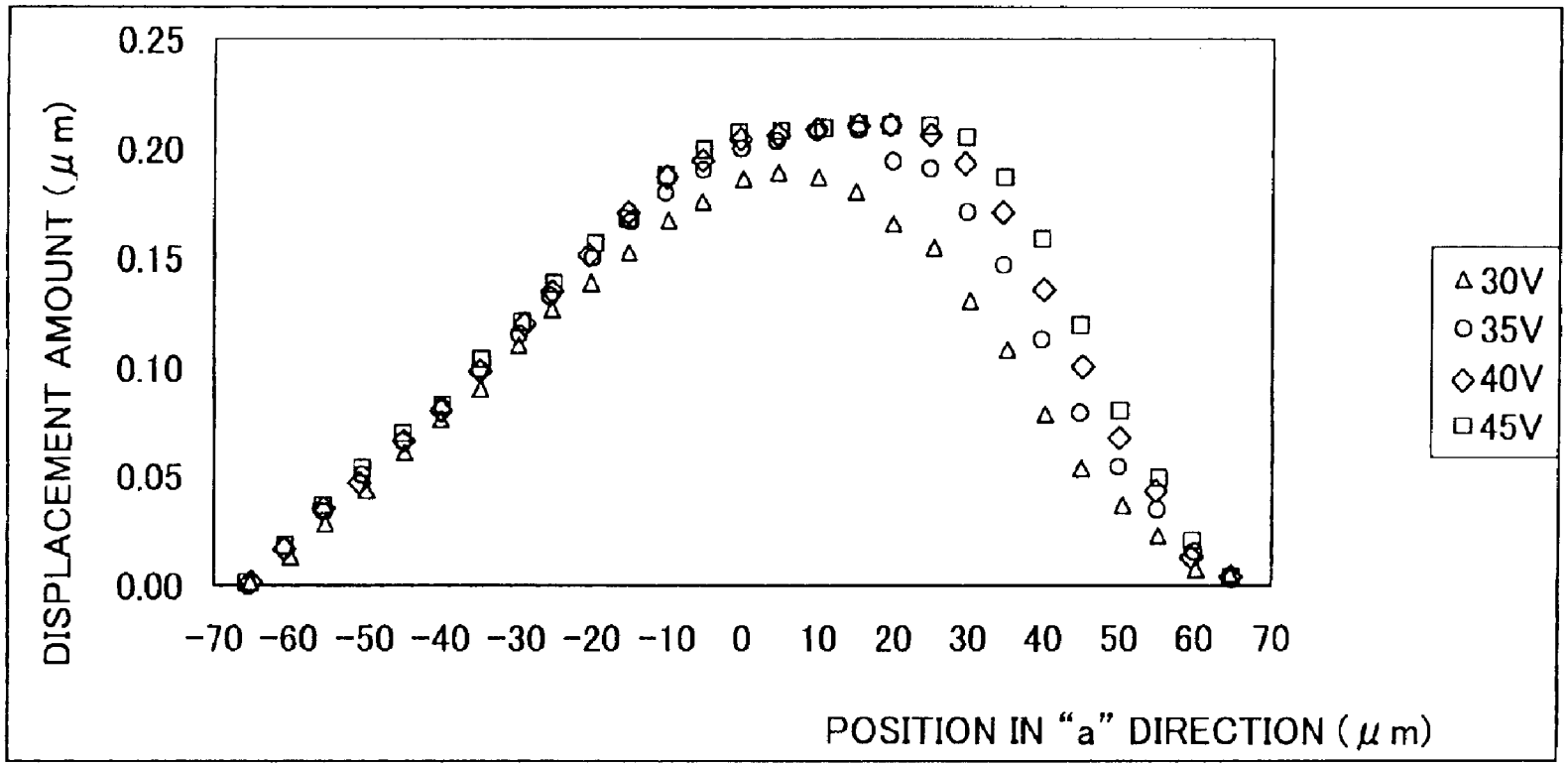
FIG. 7 shows a measurement result of the displacement of a non-parallel gap G1 form actuator in a shorter edge direction of the vibrating plate.
Figure 8:
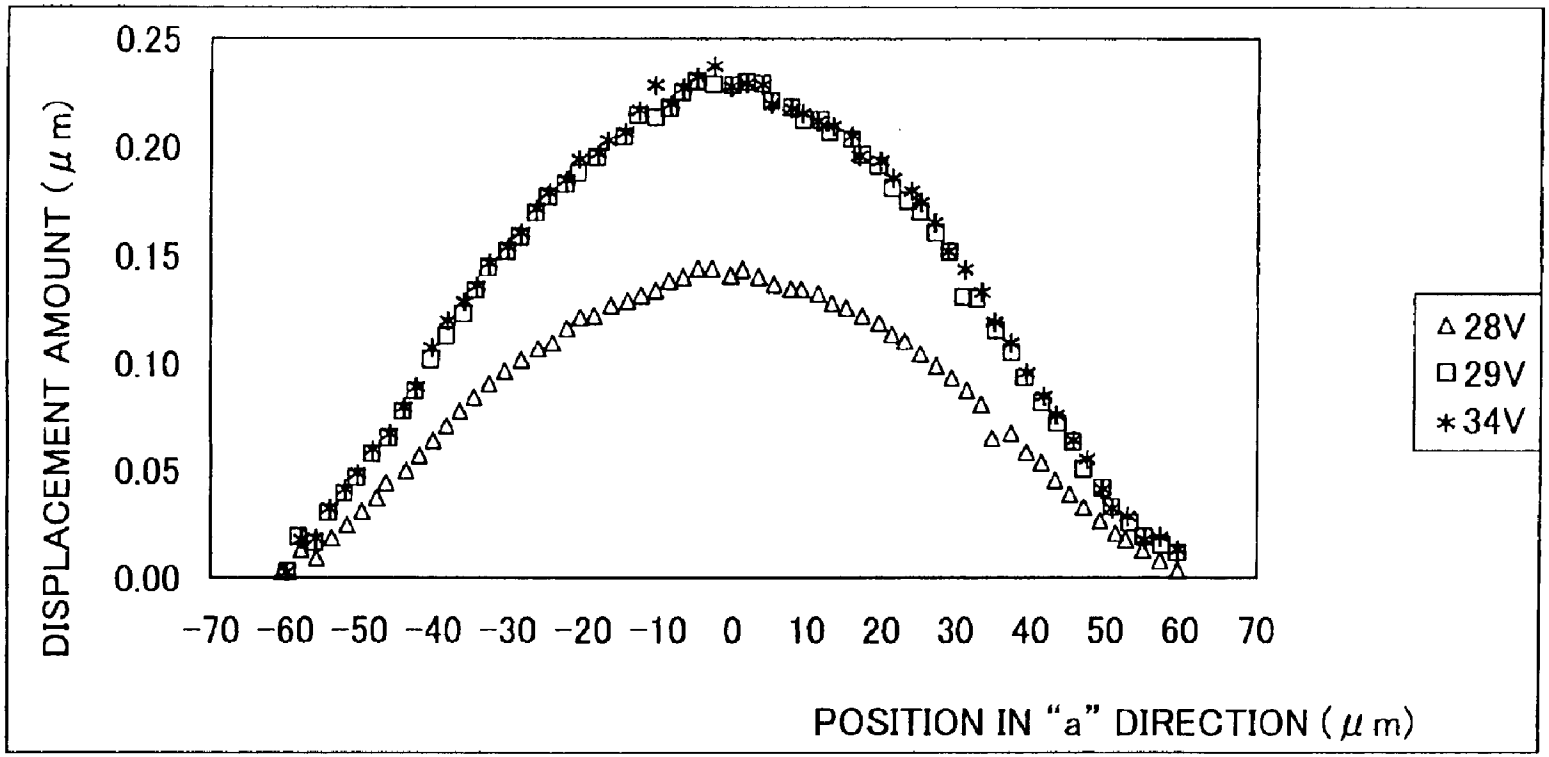
FIG. 8 shows a measurement result of the displacement of a non-parallel gap G2 form actuator in a shorter edge direction of the vibrating plate.

FIG. 6, FIG. 7 and FIG. 8 show displacement of the vibrating plate of each of the gap types of the actuator, in the direction of the shorter edge, with the contacting period set at 6 microseconds. FIG. 9 through FIG. 12 show vibration displacement amounts measured at the center in the direction of the shorter edge of the vibrating plate of the parallel gap G actuator (a 0-micrometer position in the direction of "a" of FIG. 6), the displacement amount being measured by a laser Doppler vibrograph. In FIG. 9–FIG. 12, the horizontal axis represents the magnitude of the driving voltage, the waveform of which being rectangular. In each graph and each driving condition, there are areas where increase in the displacement amount almost saturates. FIG. 13–FIG. 15 show the displacement amount of the non-parallel gap G1 actuator at a 10-micrometer position in the direction of "a" shown in FIG. 7. FIG. 16–FIG. 19 show displacement amount of the non-parallel gap G2 actuator at the 0-micrometer position in the direction of "a" shown in FIG. 8.

Figure 9:
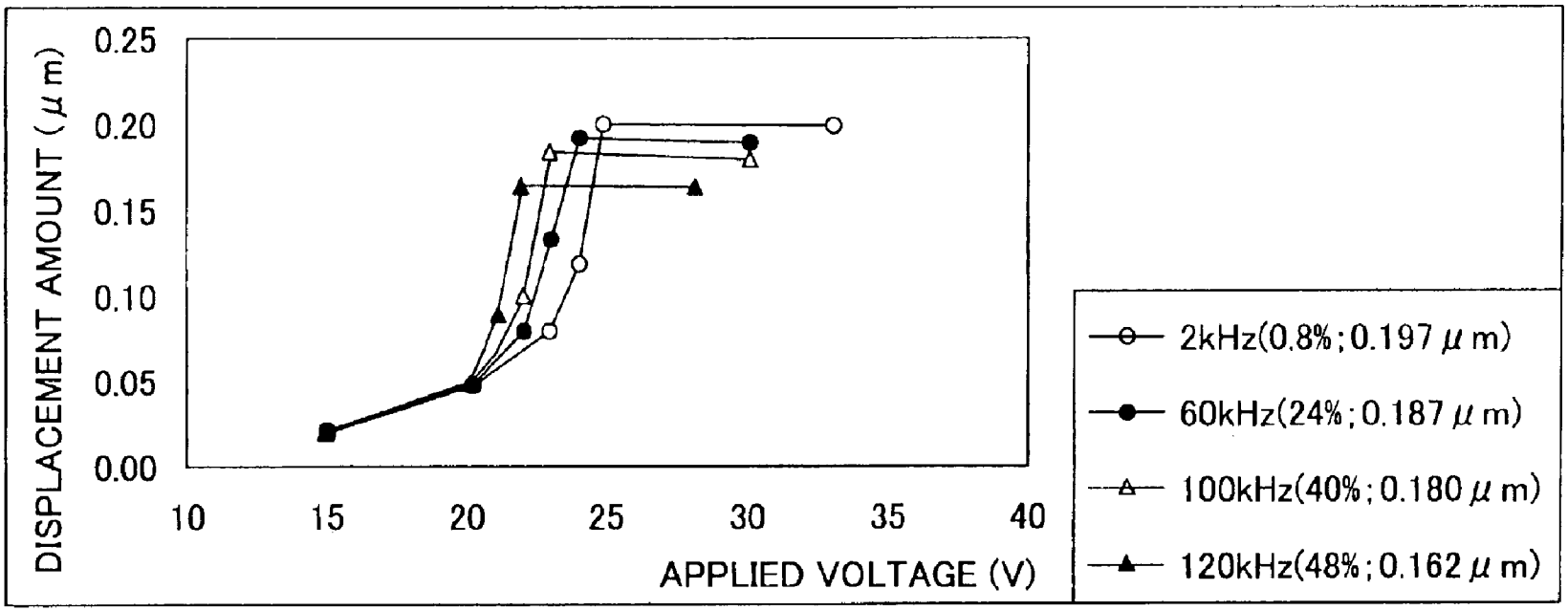
FIG. 9 shows a measurement result of vibration displacement amount (contacting period being 4.0 microseconds) of an parallel gap actuator, measured by a laser Doppler vibrograph at a center in the direction of the shorter edge of the vibrating plate.

The amount of displacement of the vibrating plate when contacting the electrode (called, contact displacement amount) is reduced, and the contact voltage becomes lower as the frequency becomes high, while the driving pulse conditions (rising time Pr=0, pulse width Pw=4, falling time Pf=0 microsecond) are the same, as shown in FIG. 9, for example. This is due to the squeezing effect, and is the dependency on [contacting period/1-pixel-forming period] of the electrostatic head, as mentioned above.

FIG. 9 through FIG. 19 indicate the following matters. Namely, the displacement amount when measured with the pulse width of the driving voltage changes, and the contacting period serving as a parameter, does not depend on the contacting period nor the driving frequency, but approximately depends on [contacting period/1-pixel-forming period].

In the case of the parallel gap G, FIG. 9 through FIG. 12 indicate that if the [contacting period/1-pixel-forming period] is controlled to fall about 40% or less, reduction of the displacement amount can be suppressed to about 10%.

Similarly, the reduction of the displacement amount can be suppressed to about 10%, if the [contacting period/1-pixel-forming period] is controlled to fall about 5.5% or less in the case of the non-parallel gap G1, as shown in FIG. 13 through FIG. 15; and if the [contacting period/1-pixel-forming period] is controlled to fall about 25% or less, in the case of the non-parallel gap G2, as shown in FIG. 16 through FIG. 19.

It is considered that the dependency on [contacting period/1-pixel-forming period] depends on a ratio of displacement volume V1 that is produced when the vibrating plate is displaced from a position when the power supply is turned off to volume of the vibrating chamber V0. When the longer edge of the vibrating plate is sufficiently longer than the shorter edge, V1/V0 can be approximated by S1/S0, where S0 is a gap area, and S1 is a displacement area produced by the displacement of the vibrating plate from the position when the power supply is turned off, as shown by the section (D) of FIG. 5, in the cross section in the short edge direction.

Table 1 that follows shows approximated values of V1/V0 that were obtained by calculating S1/S0 in an actual use voltage range, after obtaining S0 and S1 for each gap type actuator displacement form shown in FIG. 6 through FIG. 8.

TABLE 1

S1/S0 ratio in each gap type actuator

| | Gap area S0 ($\mu m^2$) | Displacement area S1 ($\mu m^2$) | Practical voltage range (V) | S1/S0 × 100(%) in practical range |
|---|---|---|---|---|
| Parallel Gap | 26 | 15.2 (25 V), 17.5 (29 V), 18.9 (38 V) | About 25 to 35 | About 58 to 71 |
| Non-parallel gap G1 | 21 | 13.6 (30 V), 15.5 (35 V), 16.6 (40 V), 17 (45 V) | About 32 to 42 | About 69 to 80 |
| Non-parallel gap G2 | 25.8 | 16.5 (29 V to 34 V) | About 28 to 38 | 64 |

Figure 10:
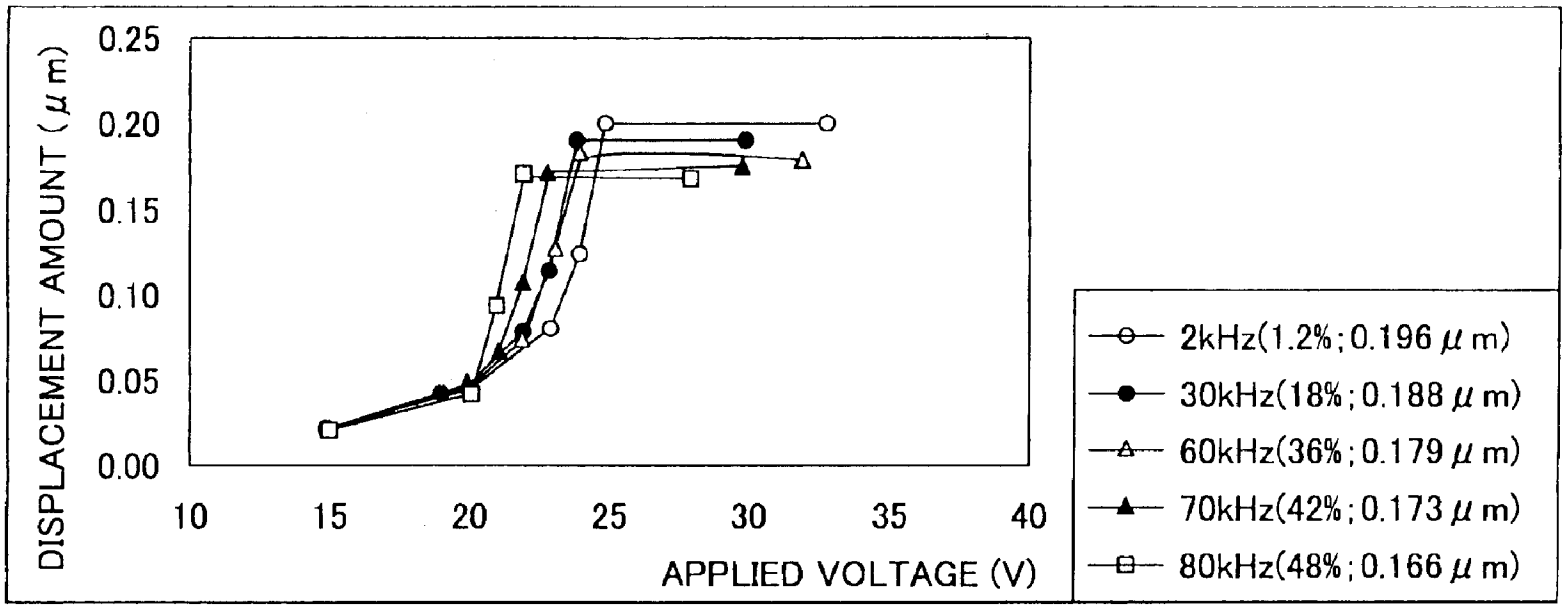
FIG. 10 shows a measurement result of vibration displacement amount (contacting period being 6.0 microseconds) of the parallel gap actuator, measured by the laser Doppler vibrograph at the center in the direction of the shorter edge of the vibrating plate.
Figure 11:
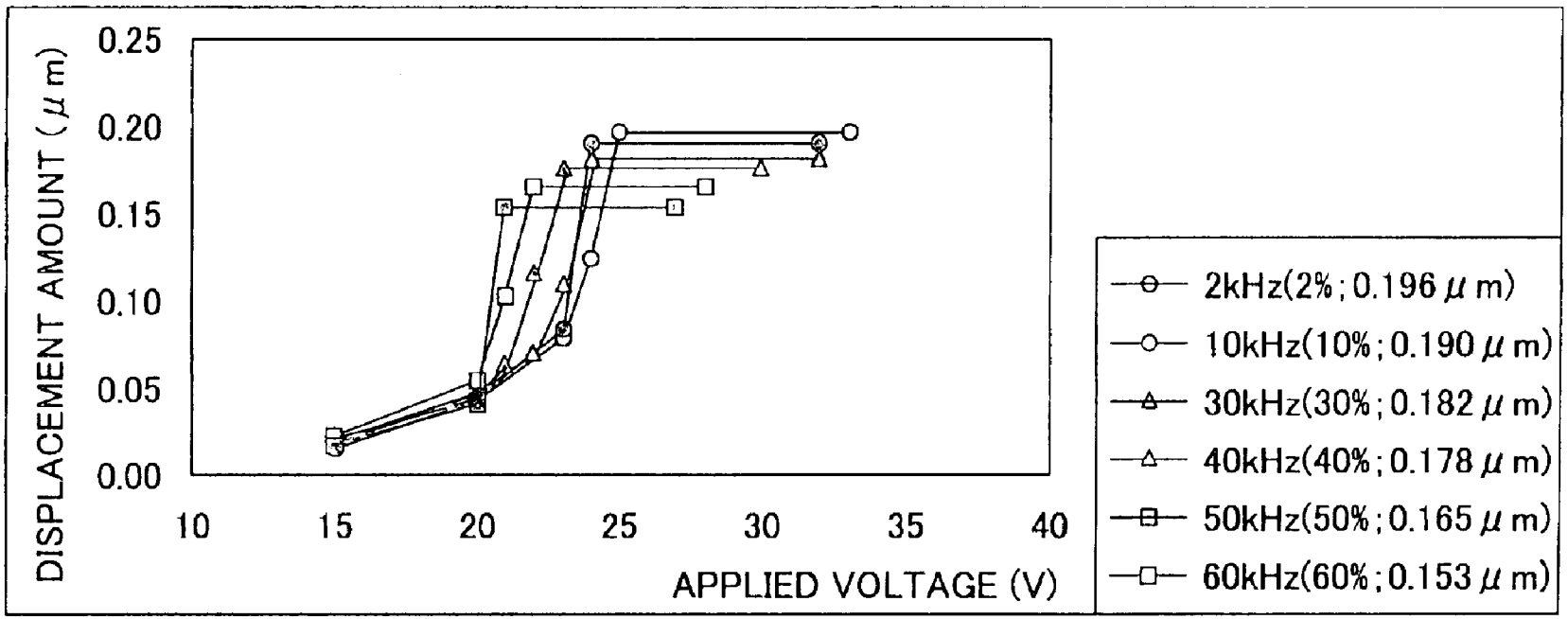
FIG. 11 shows a measurement result of vibration displacement amount (contacting period being 10.0 microseconds) of the parallel gap actuator, measured by the laser Doppler vibrograph at the center in the direction of the shorter edge of the vibrating plate.
Figure 12:
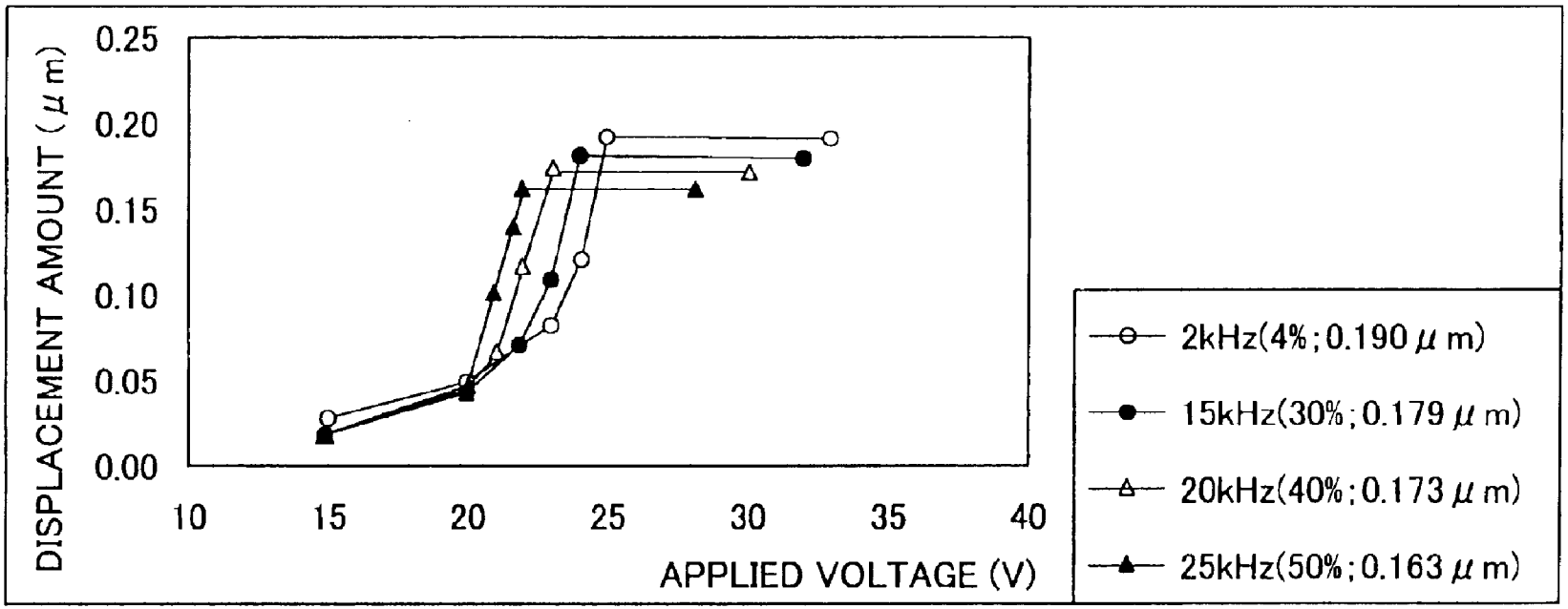
FIG. 12 shows a measurement result of vibration displacement amount (contacting period being 20.0 microseconds) of the parallel gap actuator, measured by the laser Doppler vibrograph at the center in the direction of the shorter edge of the vibrating plate.

In the meantime, a ratio of [contacting period/1-pixel-forming period] at which the amount of the displacement is reduced by 10% is obtained for each gap type from FIG. 10, FIG. 14, and FIG. 17, and is given in Table 2 below.

TABLE 2

[contacting period/1-pixel-forming period] value at which displacement amount is reduced by 10% for each gap type actuator

| | [contacting period/1-pixel-forming period] × 100% |
|---|---|
| Parallel Gap | 36 |
| Non-parallel Gap 1 | 5 |
| Non-parallel Gap 2 | 24 |

The values of S1/S0×100(%) corresponding to the lowest practical voltage in Table 1, namely, 58 (parallel gap G), 69 (non-parallel gap G1), and 64 (non-parallel gap G2), and the result of Table 2 are plotted in a graph. Then, linear approximation is carried out. Then, the following expression of relations is drawn as a result.

That is, if PT (%) is taken within the limits of (200−2.79×PV), reduction in the displacement amount due to the squeezing effect can be suppressed to a level that does not cause a problem, where PV (%) is a ratio of the displacement volume of the vibrating plate to the volume of the space enclosed by the vibrating plate and the electrode, and PT (%) is a ratio of the period during which the vibrating plate and the electrode contact to the period required in forming a pixel.

The frequency characteristics of the electrostatic ink jet head are remarkably improved, stability of the ink discharging characteristic is raised, and, as a result, reliability of the head is raised by properly setting the ratio of the period of the electric pulse applied between the vibrating plates and the individual electrodes of the electrostatic ink jet head to the period required in forming a pixel (substantially, the portion of the period during which the vibrating plate contacts the electrode), and by properly setting the ratio of the gap chamber volume to the vibrating chamber volume.

What is claimed is:

1. An electrostatic ink jet head, comprising:

a vibrating plate, and an electrode installed facing the vibrating plate at a predetermined gap; wherein, an electric pulse is applied between the electrode and the vibrating plate such that the vibrating plate is displaced by electrostatic force, and an ink drop is discharged by mechanical resilience of the vibrating plate pressurizing ink in the ink chamber; wherein, a pixel is formed by the ink that is discharged by one electric pulse; and where a ratio PT of a period during which the vibrating plate and the electrode contact each other to a period required to form a pixel is equal to or less than (200−2.79×PV) %, where PV is a per cent ratio of displacement volume of the vibrating plate to volume of a vibrating chamber that is a space enclosed by the vibrating plate and a board of the electrode.

2. An electrostatic ink jet head, comprising:

a vibrating plate, and an electrode installed facing the vibrating plate at a predetermined gap; wherein, an electric pulse is applied between the electrode and the vibrating plate such that the vibrating plate is displaced by electrostatic force, and an ink drop is discharged by mechanical resilience of the vibrating plate pressurizing ink in the ink chamber; wherein, a pixel is formed by the ink that is discharged by a plurality of electric pulses; and where a ratio PT of a period during which the vibrating plate and the electrode contact each other to a period required to form a pixel is equal to or less than (200−2.79×PV) %, where PV is a per cent ratio of displacement volume of the vibrating plate to volume of a vibrating chamber that is a space enclosed by the vibrating plate and a board of the electrode.

3. An electrostatic ink jet head, comprising:

a nozzle, an ink chamber that is connected to the nozzle a vibrating plate that constitutes a common electrode, an individual electrode installed outside the ink chamber, and facing the vibrating plate at a predetermined gap; and a plurality of electrostatic actuators that discharge ink drops from the nozzle, the ink being the ink chamber and pressurized by mechanical resilience of the vibrating plate when the vibrating plate is deformed by electrostatic force generated by an electric pulse applied between the vibrating plate and the individual electrode; where a ratio PT of a period during which the vibrating plate and the electrode contact each other to a period required to form a pixel is equal to or less than (200−2.79×PV) %, where PV is a per cent ratio of displacement volume of the vibrating plate to volume of a vibrating chamber that is a space enclosed by the vibrating plate and a board of the electrode.

4. The electrostatic ink jet head as claimed in claim 3, wherein one electric pulse is applied between the vibrating plate and the individual electrode when forming one pixel.

5. The electrostatic ink jet head as claimed in claim 3, wherein a plurality of electric pulses are applied between the vibrating plate and the individual electrode when forming one pixel.

6. An ink jet recording apparatus, comprising the electrostatic ink jet head as claimed in any one of claims 1 through 5, wherein the electrostatic ink jet head faces recording paper such that recording is performed by ink jet drops.

* * * * *